US009149708B2

(12) United States Patent
Chen

(10) Patent No.: US 9,149,708 B2
(45) Date of Patent: Oct. 6, 2015

(54) INFLATABLE GAME FIELD SYSTEM

(76) Inventor: Xing Chen, Charlotte, NC (US)

( * ) Notice: Subject to any disclaimer, the term of this patent is extended or adjusted under 35 U.S.C. 154(b) by 15 days.

(21) Appl. No.: 14/116,127

(22) PCT Filed: May 6, 2011

(86) PCT No.: PCT/CN2011/073757

§ 371 (c)(1),
(2), (4) Date: Jun. 9, 2014

(87) PCT Pub. No.: WO2012/151733

PCT Pub. Date: Nov. 15, 2012

(65) Prior Publication Data

US 2014/0295980 A1 Oct. 2, 2014

(51) Int. Cl.

| | |
|---|---|
| ***A63G 31/12*** | (2006.01) |
| ***A63B 67/00*** | (2006.01) |
| ***A63B 71/02*** | (2006.01) |
| ***A63B 9/00*** | (2006.01) |
| ***F41J 11/00*** | (2009.01) |
| ***F41J 11/02*** | (2009.01) |

(52) U.S. Cl.

CPC ..... *A63B 71/022* (2013.01); *A63B 9/00* (2013.01); *A63B 67/00* (2013.01); *A63B 71/02* (2013.01); *F41J 11/00* (2013.01); *F41J 11/02* (2013.01); *A63B 2009/006* (2013.01); *A63B 2225/62* (2013.01)

(58) Field of Classification Search

CPC ... A63G 31/00; A63G 31/12; A63B 2225/02; A63B 10/00; A63B 2009/006; E04H 15/00; E04H 15/20; E04H 2015/201

USPC ..... 472/89, 90, 92, 134; 52/2.11, 2.22, 52/2.23; 446/219–220, 225–226

See application file for complete search history.

(56) References Cited

U.S. PATENT DOCUMENTS

| | | | | |
|---|---|---|---|---|
| 2,731,768 | A * | 1/1956 | Harrowe | 446/226 |
| 3,578,318 | A * | 5/1971 | Young | 472/134 |
| 6,008,938 | A * | 12/1999 | Suehle et al. | 359/443 |
| 7,089,703 | B2 * | 8/2006 | Brereton | 52/2.23 |

* cited by examiner

*Primary Examiner* — Kien Nguyen

(74) *Attorney, Agent, or Firm* — Aidenbaum Schloff and Bloom PLLC; Jay Schloff

(57) ABSTRACT

An inflatable game field system includes at least two inflatable modules, at least one connecting pipeline and one air inlet system connected to blower(s). The inflatable modules are connected by the connecting pipeline, and the air inlet connects to one of the module at one end and connects to a blower at the other end, so that the air flow coming from the blower can move freely between the modules. This game field system can be setup in various locations, formed different field sizes and provide a safe game field.

12 Claims, 12 Drawing Sheets

INFLATABLE GAME FIELD SYSTEM

CROSS-REFERENCE TO RELATED APPLICATIONS

The present application claims priority under 35 USC §119 on the Patent Cooperation Treaty application PCT/CN2011/073757, filed on May 6, 2011, the disclosure of which is incorporated by reference.

FIELD

The present disclosure relates to inflatable game systems, and more specifically, to an inflatable game field system that may be used for various team games and sports, such as "laser tag", paintball, air soft, dodgeball, and the like.

BACKGROUND

Games such as "laser tag", paintball, air soft, dodgeball, etc. require a game field or system with obstacles inside so that game players can compete against each other simulating different game formats, such as certain a video game, a war game, or other game formats. In many situations, the game will be conducted at a temporary location instead of at a facility, so mobility of the game field or system is required. The game field size also may vary from time to time depending on number of participants and game format. The more participants, the bigger the field size that is required. Therefore, a game field system with the capability to change size as needed is greatly desired. For all game fields, safety is always a top priority.

Obstacles inside the field or system are required to form the internal field layout. There are many ways to build or generate the obstacles. Some obstacles use existing items, such as old trucks, cars, planes, etc. Some obstacles are built from lumber, plastic pipe, wood spools, pallets, etc. All these obstacles may be well-suited for a game field set-up that is in a permanent location, however it would be time consuming and costly to transfer such obstacles to a different location. These obstacles are definitely not designed for mobility. All the hard material from which the obstacles may be formed may come with sharp edges, angles or points, which may be a safety concern for game players.

There are inflatable game obstacles currently available. The inflatable game field and obstacles can be divided in two main categories, i.e. constant-air design or air-tight design, according to how they maintain an inflated shape. The air-tight game field is formed by a plurality of individual inflatable obstacles. Each individual inflatable obstacle is inflated and sealed individually. Once it is inflated, it can maintain the inflated shape for hours for gaming use. The quantity of the obstacles usually depends on the game field size, and can range from 10-50 units, for example. The various individual inflatable obstacles may be designed in varying sizes and shapes to increase the diversity of the game field. The air-tight obstacle game field system allows for great mobility and flexibility in forming the size of the field. However, each air-tight obstacle requires at least 1 to 5 minutes to be inflated (depending on the size of the obstacle), therefore setting up the game field with this arrangement (especially a large-size field) may take hours. Furthermore, the same amount of hours, or more, may be needed to take them down.

Another drawback for the air-tight obstacles is that when the sealed obstacles are used in an outdoor environment, the sun and heat will increase the internal pressure quickly, causing the obstacles overinflate and burst. Due to the air-tight requirement, any minor leak from anywhere on such an inflatable obstacle will deflate the obstacle and stop it from functioning properly.

The other main kind of inflatable game field is a constant-air inflatable, which requires constant-air flow supplied from a blower to maintain the inflated shape. The constant-air game fields normally are pre-made in size and with regard to the internal layout of obstacles. They are inflated and maintain their inflated shape via the constant air flow of the blower, which blower connects to the inflatable via an air inlet, usually located about 1-2' above ground and extending out of the side of the inflatable, to correspond to the height and location of the blower. To form a bigger field size as needed, multiple constant-air fields can be used together. When they are used together, they are inflated separately by their respective blowers. For a constant-air game field, they are pre-made in size, thus lacking the ability to change field size as needed. Also, the air inlet extending from the side of such a game field may constitute a tripping hazard. When multiple constant-air field are in used, due to the fact that each inflatable is inflated individually via its blower, multiple power sources are needed for the separate blowers, or multiple extension cords are needed to supply power from a centralized power source. The increased number of air inlets definitely increases the risk of a tripping hazard. Moreover, the extension cords create an additional concern of electric shock. Another limitation is that these pre-made inflatable game fields can only be used together in certain orientations or configurations, dependent on how they are pre-made or the location(s) of a power source, for example.

DISCLOSURE SUMMARY

The present disclosure of an inflatable game field system comprises a constant-air inflatable modules game field system, which will dramatically decrease set up time, provides great flexibility in changing the size of a field as needed and importantly, creates a game field without a tripping hazard and maximizes the safety for the game players.

The disclosure is a constant inflatable modules system, including at least two modules, a connecting pipeline and an air inlet system. Modules are connected via the pipeline and the air inlet connects to one module at one end and a blower at the other end. In this way, the air flow from the blower can move freely between modules.

The inflatable module in this disclosure is a component of the game field system. Each module comes with inflatable walls, which walls may form a perimeter of a certain shape and size. Inside the perimeter, there is may be a unique inflatable obstacle layout. These inflatable obstacles are connected with perimeter walls to form a complete inflatable system where air flow can move freely among and within perimeter walls and the internal obstacles. Once inflated, the whole module (including its internal obstacles) is inflated at one time. A single module can be used as game field.

There are connecting points located on each module, through which more than one module can be connected via a connection pipeline. Once connected, the modules form a complete inflatable system where air flow can move freely between/among modules. The connecting pipeline, once connected and inflated, will be disposed above the module, effectively forming an archway over above the modules. The air inlet can also be connected through such connecting points via a connecting pipeline or directly. Once the air inlet connects to a blower, the airflow can pass to all connected modules and inflate them at one time. If more than one blower is needed to support more modules, the disclosure adapts an innovative consolidated air inlet system, which allows multiple blowers to attached together at the same location to the same air inlet.

With a connecting pipeline, modules are connected and the air flow can move freely between modules, so there is no need to inflate each module individually. With the archway connecting pipeline and inlet, the disclosure eliminates the tripping hazard of the prior art constant-air inflatable and creates a safe gaming field. With the top connecting points configuration, as many modules can be connected as needed, forming any size of game field, and expanded in any directions without limitation, in contrast to the prior art contact air inflatable devices, which can only be connected in pre-designed direction and/or position.

BRIEF DESCRIPTION OF THE DRAWINGS

The following drawings illustrate how the disclosure be applied. The drawings show some examples of the application and do not mean the disclosure can only be applied in these ways.

DETAILED DESCRIPTION OF THE DISCLOSURE

Figure 1:
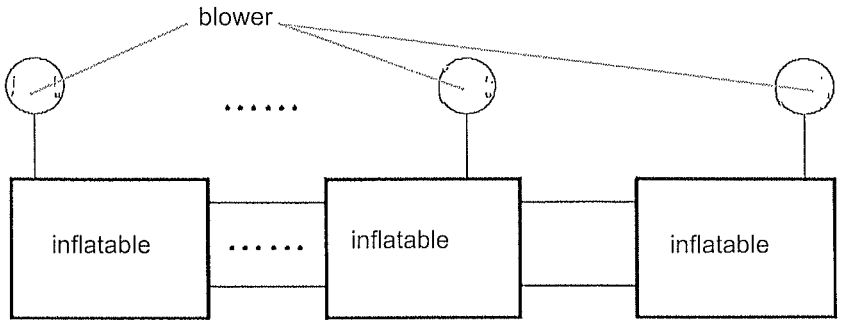
FIG. 1 shows a prior-art constant-air inflatable air inlet and connection.

Below is the detailed explanation on how the disclosure works. The explanation is only for one example of the disclosure and not all the variations. Any other variations originating from such explanation should be protected under this disclosure.

The disclosure provides a unique and innovative inflatable game field system inflated with a constant-air supply. It includes at least two modules, a connecting pipeline and an air inlet system. The modules are connected via the pipeline. The air inlet system connects to one of the modules at one end and connects to blower at the other end. Once connected, the air supply from the blower can flow freely among modules.

The inflatable system, including modules, connecting pipeline and air inlet system, is made from soft and flexible materials such as tarpaulin or similar fabric. When it is not inflated, the modules can be packed in small sizes for easy handling and transportation. Once inflated, the inflatable forms the pre-designed module shapes quickly, (with examples as shown in the drawings). The inflated walls and obstacles are air-padded, functioning like an air cushion, providing a safe gaming field for game players.

Each module has connecting points where the pipeline can be attached and connected. The connecting points are located on the top surface of the module once the modules inflated. When a connecting pipeline is used to connect two modules together, such connecting pipeline forms an archway shape above the modules and such archway is in a position where it does not interfere with any modules or game players. With a connected pipeline, there is clear distance between modules where the players can pass or hide. Such distance depends on length of the connecting pipeline.

Prior art inflatables, as shown in FIG. 1, when they need to connect to each other, are connected side to side via connecting pipe from side of the wall. The air inlet normally extends out from the side of wall, about 1-2 feet above ground, at a similar height to that of the blower. Such side-extending connecting pipeline or air inlet will block passage in the area and create a tripping hazard for the game players who need to pass in the vicinity.

Figure 2:
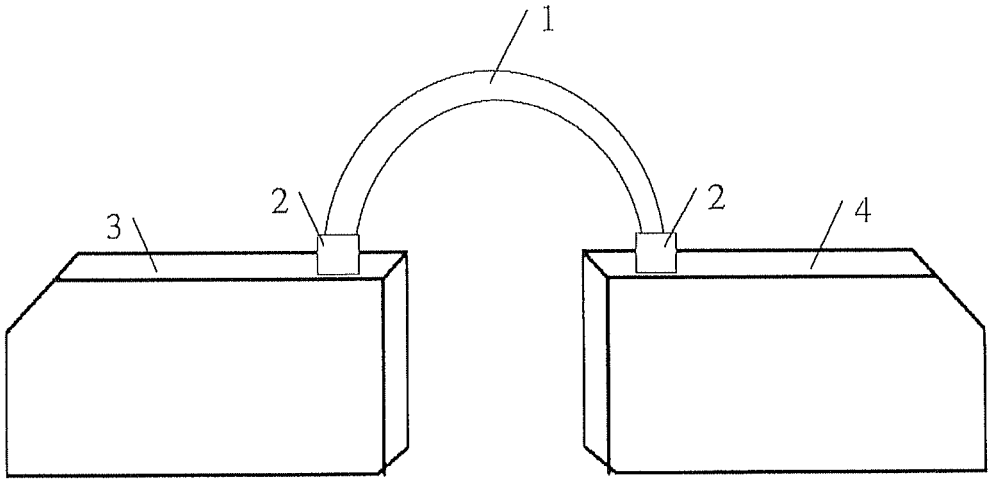
FIG. 2 show a sectional view of the connecting pipeline between two modules, in accordance with an embodiment of the present disclosure.

FIG. 2, as an example, shows the side view of modules of the present disclosure connected via connecting pipeline once they are inflated. In this illustration, both ends of the connecting pipeline are disposed on top of each module, forming an archway shape connecting above the modules.

FIG. 2 only shows a side section of connecting pipeline 1, the top surface 3 of first inflated module and the top surface 4 of second inflated module. On the top surface 3 and 4, there are connecting points 2 respectively. Connecting pipeline 1 connects to both connecting point 2, which point is disposed on surface 3 and 4. The connecting pipeline 1, once inflated, is disposed above the top surface of the connected modules as shown. The disclosure creates an innovative "over the above" connecting design, which will neither cause any interference with modules and/or game players, nor create any tripping hazard for the player. With "over the above" connection design, the modules can be connected in any direction, meaning the game field can be extended in any direction, which allows the game field system to be set up in any desired way and fit various setup locations. FIG. 2 shows the connecting pipeline in an arch shape, however, it can also be a square shape or triangle shape, or any other shape or modification, whenever the connecting pipeline is above the modules and high enough to create clear space for game players to pass under.

Figure 3:
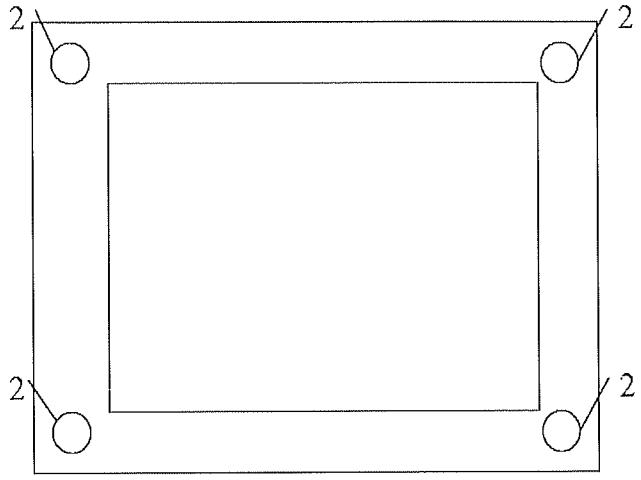
FIG. 3*a* shows a square shape design of the module, in accordance with an embodiment of the present disclosure.
FIG. 3*b* shows a circular shape design of the module, in accordance with an embodiment of the present disclosure.
FIG. 3*c* shows a pentagon shape design of the module, in accordance with an embodiment of the present disclosure.
FIG. 3*d* shows a hexagon shape design of the module, in accordance with an embodiment of the present disclosure.
FIG. 3*e* shows a star shape design of the module, in accordance with an embodiment of the present disclosure.
Figure 3:
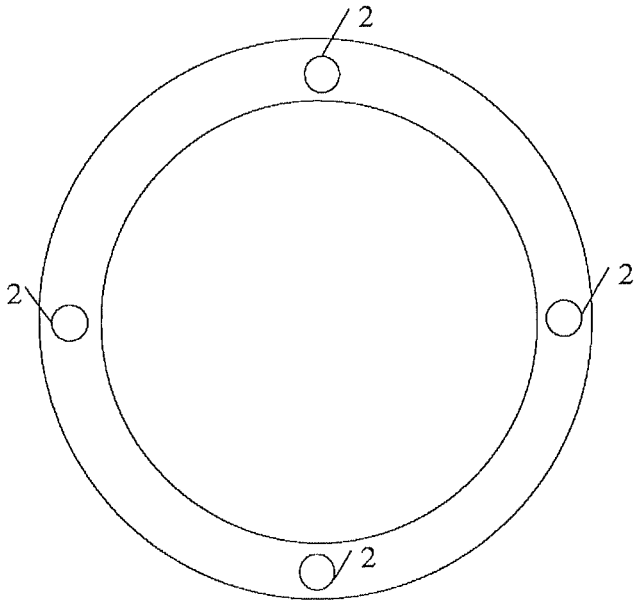
Figure 3:
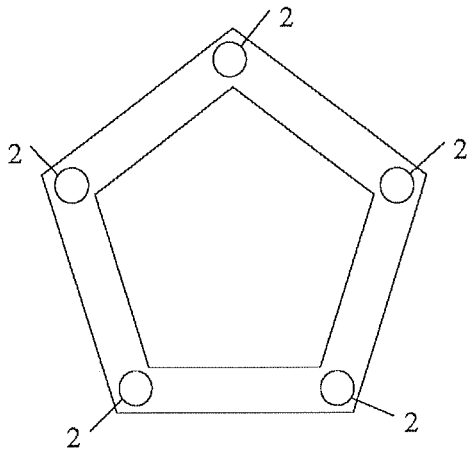
Figure 3:
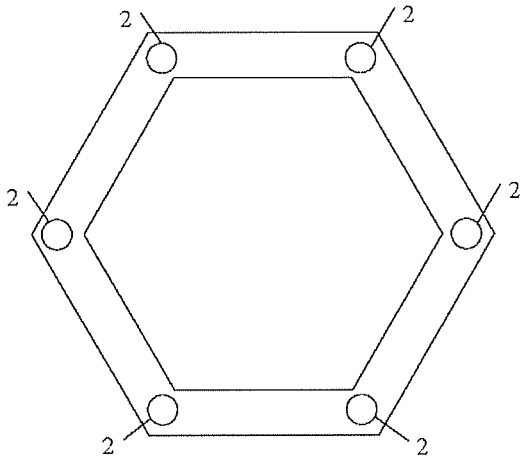
Figure 3:
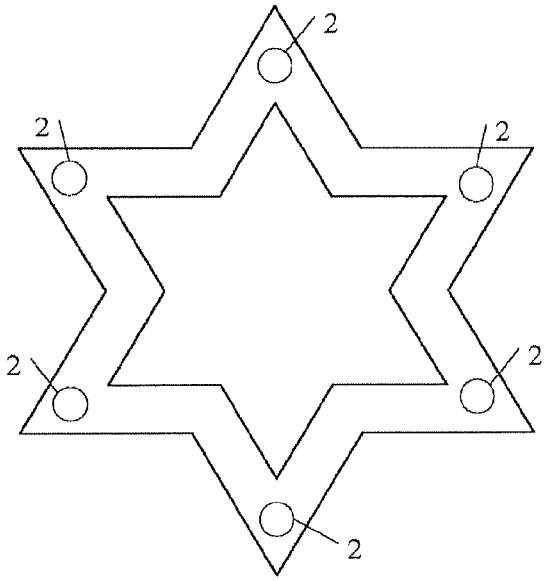

The location of the connecting points is on top surface of the perimeter wall of the modules. It can be in different spots, depending on the shape of the modules. In a preferred embodiment, the connecting points are disposed at the spots where they can minimize the connecting distance and maximize the connecting directions. For example, for multi-sided modules, the connecting points can be at the corners of jointed walls. When in circular shape, the connecting points can be evenly located. FIG. 3*a* shows the four connecting points at the four wall corners for square/rectangular shaped modules. FIG. 3*b* shows the four evenly located connecting points for the circular-shaped modules. With multiple connecting points, the modules can be connected endlessly in any direction, which enables the game field to change size and configuration as needed and be set up in any directions to fit the location.

When multiple prior art inflatables are used together, as shown in FIG. 1, each inflatable gets its own blower and is inflated individually. The air flow stays inside each individual inflatable and cannot be shared. For such a setup, multiple power sources in different locations matching the locations of the blowers are needed. That may a problem in many temporary setup locations. The solution is to run an extension cord for each blower from power source, which creates potential safety hazards, such as tripping and/or electric shock. With individually inflated inflatables, the air flow from blowers cannot be shared, which reduces the efficiency of a blower.

The inflatable system disclosed herein, including the connecting pipeline, is made from soft and flexible material such as PVC or nylon fabric. Prior connection solutions (such as zippers or Velcro™ or similar methods) have been used to connect the soft material to each other. Such connection may be disconnected by the pressure of the air flow. Once disconnected, it is very hard to reconnect, unless the whole inflatable is deflated. Also, the connection may be twisted and close the air flow due to the mismatch of the connecting pipelines.

The disclosure provides an innovative "hard connect" connecting system so that the connecting pipeline can be connected quickly, easily and tightly between modules (even if the inflatable is inflated and in use). The "hard connect" design uses a matching coupling set made from hard material such as plastic or metal. The one side of the coupling set is fastened on the connecting points on the module and the other matching side of the coupling fastened to the both ends of the connecting pipeline. When the same matching coupling sets are used, the connecting pipeline can connect to any connecting points universally. The coupling set can be round or square of any other shape that allows for corresponding engagement between the two sides. It will be understood that the size of the coupling set is big enough to allow enough air flow to pass between modules. The matching coupling set can fit into each other in many ways, such as matching thread, twist and lock, etc. With a matching coupling set, the connecting pipeline can connect to the connecting point on the module easily and form a tight connection against air pressure. Furthermore, the matching coupling set made from hard material will not create twisting or close the air flow. For those connecting points not in use, they can be sealed and covered up to prevent air from leaking out.

With "hard connect" system, multiple modules can share the air flow from the blower easily and quickly. However with more modules connected, one blower may not be able to provide enough air flow to inflate all of them, therefore, additional blowers may be needed. The disclosure creates a consolidated air inlet design, which can allow more than one blower in the same location and provide the air flow needed for all modules. The consolidated air inlet design allows a plurality of blowers to share the same location power source without running multiple extension cords, which avoids tripping and electric shock hazards present in the prior art. Also, shared air flow maximizes blower efficiency and productivity.

Figure 4:
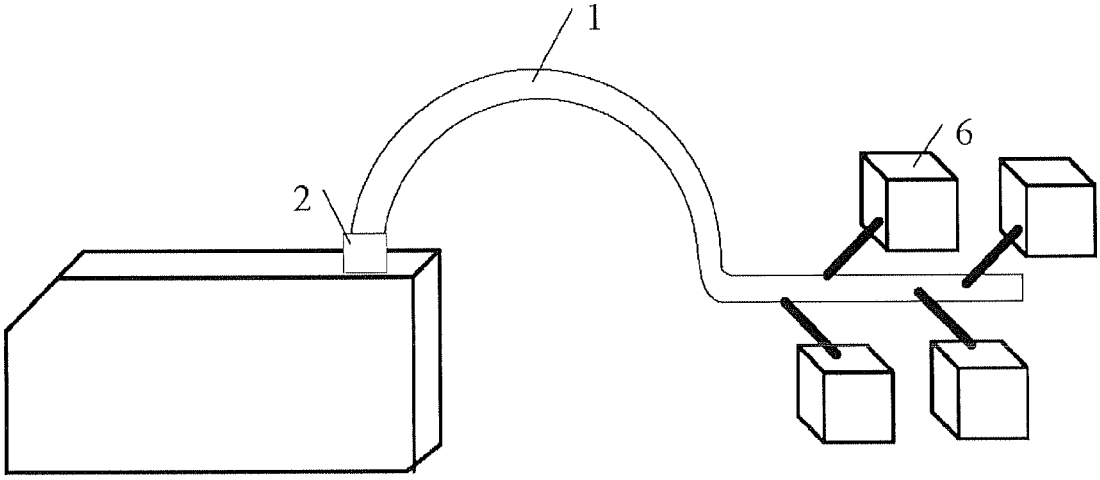
FIG. 4 shows a consolidated air inlet design, in accordance with an embodiment of the present disclosure.

FIG. 4 shows an exemplary design of the consolidated air inlet. It includes one air inlet pipeline 1. One end of the pipeline 1 connects to the connecting point 2 on top of the modules, and another end of the pipeline 1 has an end where multiple blower connecting points can connect to the blowers 6 (at both sides of the pipeline 1, for example).

Figure 5:
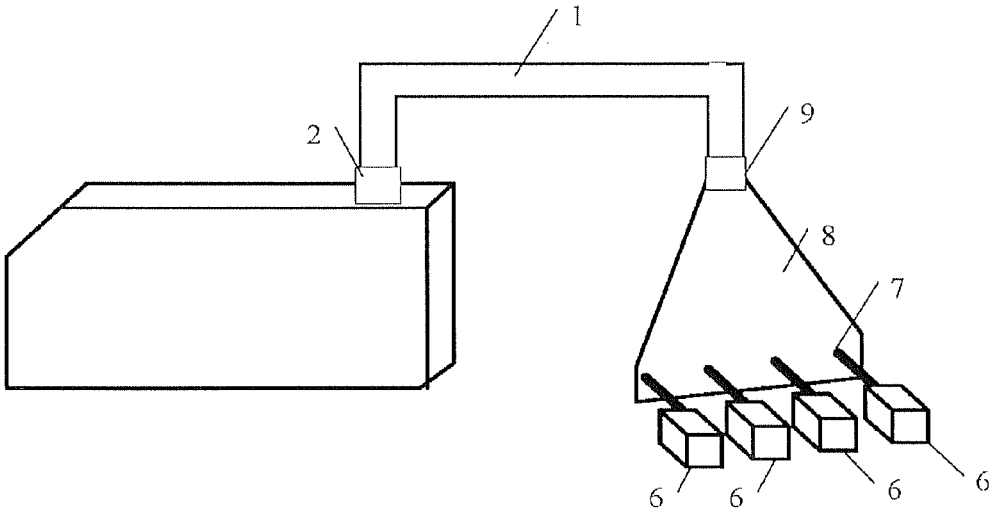
FIG. 5 shows a consolidated air inlet design, in accordance with an embodiment of the present disclosure.

FIG. 5 shows another design of the consolidated air inlet. In this embodiment, the consolidated air inlet 8 is triangular in shape. On the top of consolidated air inlet, there is connecting point 9, similar to connecting point 2 of FIG. 4) on top of the module. The connecting pipeline 1 connects to the connecting point 2 on top of the modules and the connecting point 9 through "hard connect" coupling set, so that the air flow from consolidated air inlet 8 can move freely to all connected modules. At the bottom of the consolidated air inlet 8, there are multiple blower connecting points 7. Multiple blowers 6 are connected to the consolidated air inlet 8 via blower connecting points 7.

Figure 6:
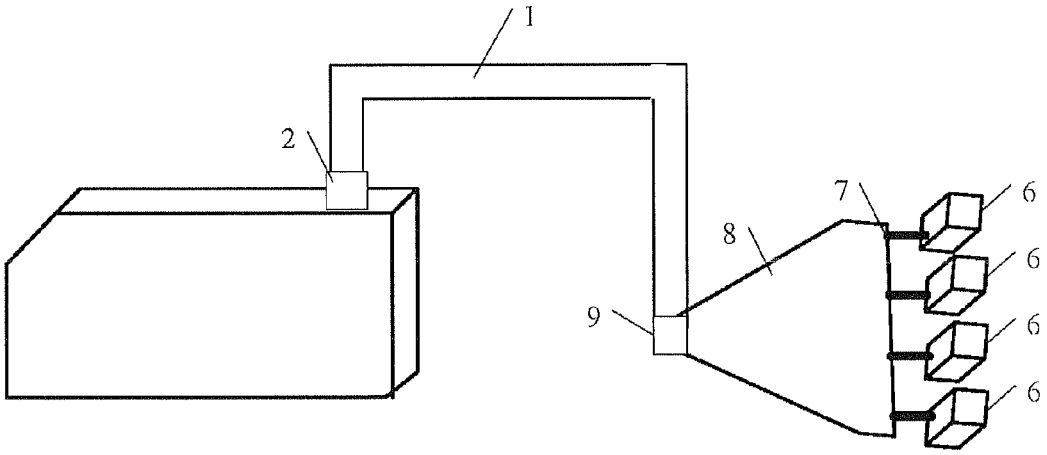
FIG. 6 shows another configuration of a consolidated air inlet design, in accordance with an embodiment of the present disclosure.

FIG. 6 shows another design, similar to that of FIG. 5. Instead of vertical consolidated air inlet, it shows the horizontal consolidated air inlet 8. The blower connecting points 7 connect to blowers. Connecting point 9 connects to pipeline 1.

Figure 7:
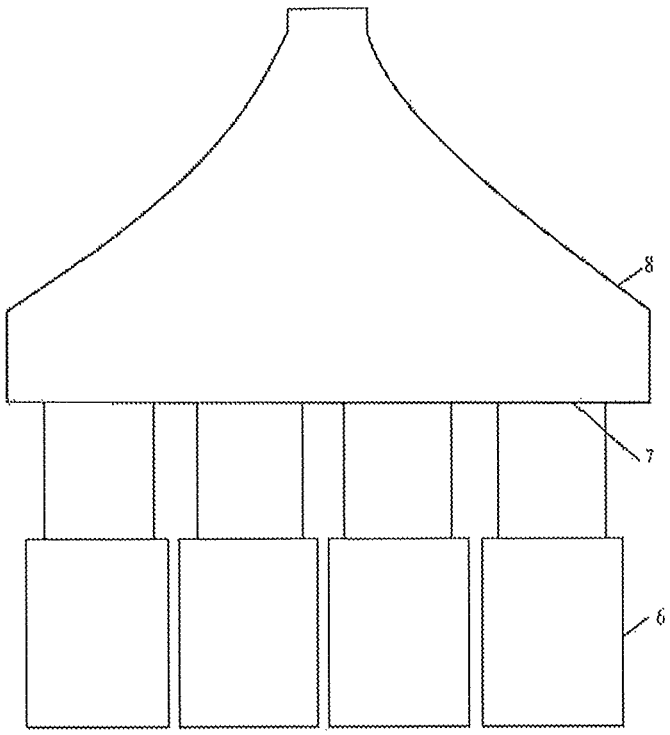
FIG. 7 shows an enlarged partial view of a consolidated air inlet design, in accordance with an embodiment of the present disclosure.
Figure 8:
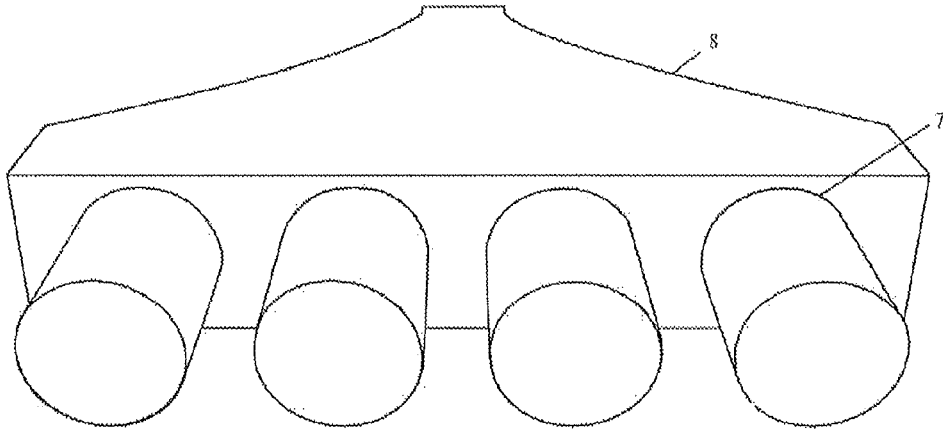
FIG. 8 shows another partial view of a consolidated air inlet design, in accordance with an embodiment of the present disclosure.

FIG. 7 shows a partial view of the embodiment of the consolidated air inlet 8, blower connecting point 7 and blower 6. FIG. 8 shows in detail the embodiment of the consolidated air inlet 8 and blower connecting point 7.

There is no specific shape required for the consolidated air inlet. Preferably, the consolidated air inlet is large enough to accept the quantity of the blower connecting points needed. The connecting point 9 on the consolidated air inlet 8 may use the same coupling of the connecting point 2 on top of the modules. In this way, the connecting pipeline 1 can be used in either direction for easy connection, creating the same above the modules connection with the clear space needed for the game players. All blowers can be located on the other side of the clear space where they can share and connect to the power sources without needing extension cords. This design eliminates the tripping hazard created by traditional air inlet and greatly reduces the electric shock concern without extension cords present.

Figure 9:
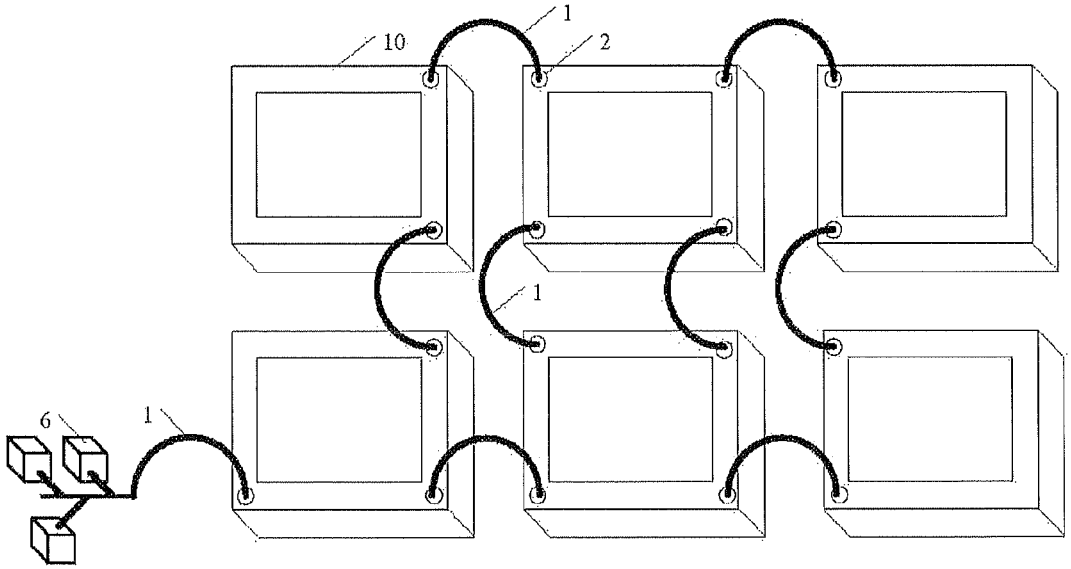
FIG. 9 demonstrates an exemplary setup of the disclosure, in accordance with an embodiment of the present disclosure.
Figure 10:
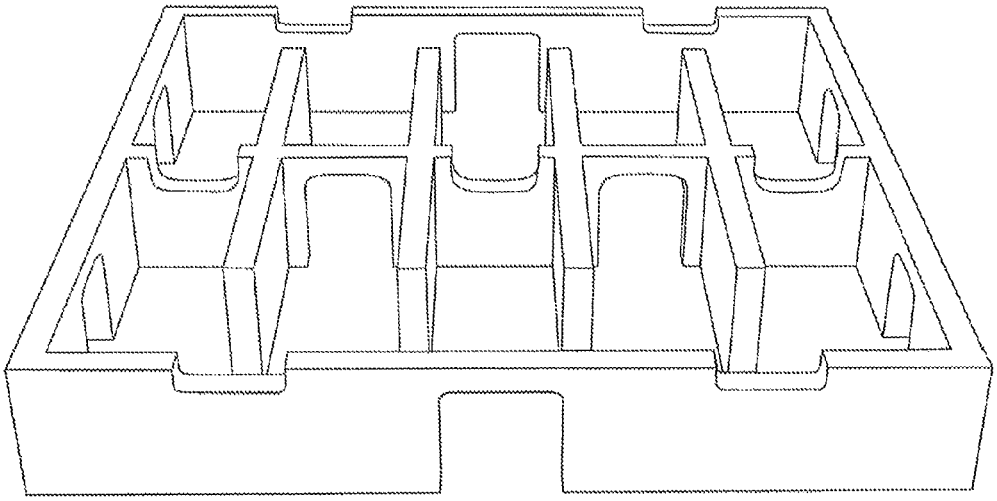
FIG. 10 shows an internal obstacle layout design of the modules, in accordance with an embodiment of the present disclosure.
Figure 11:
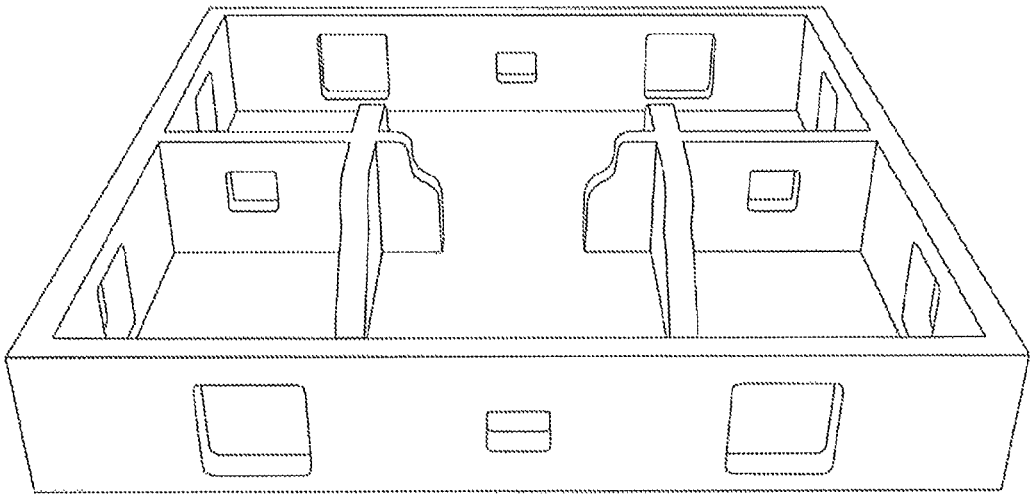
FIG. 11 shows another internal obstacle layout design of the modules, in accordance with an embodiment of the present disclosure.
Figure 12:
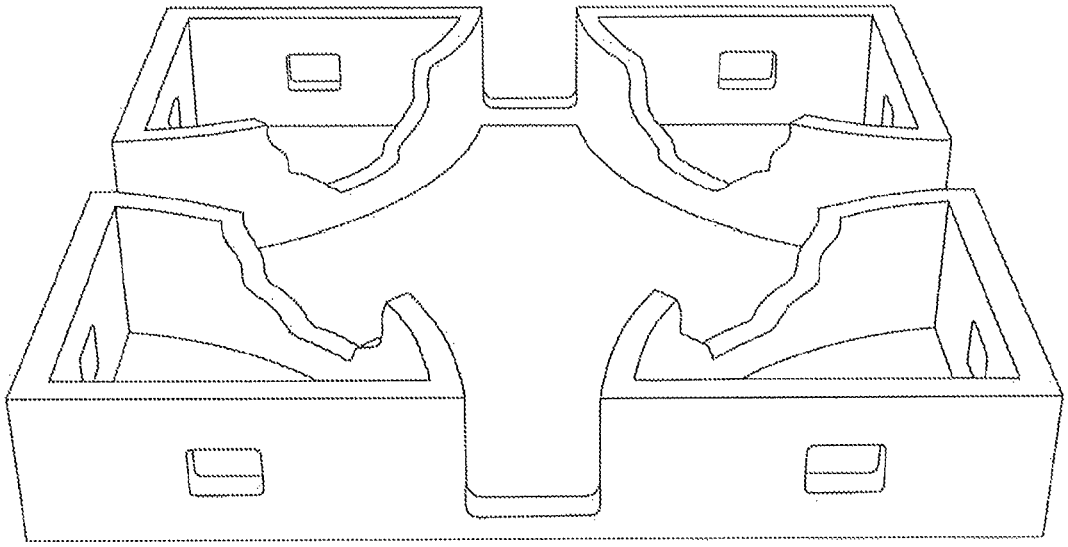
FIG. 12 shows another internal obstacle layout design of the modules, in accordance with an embodiment of the present disclosure.
Figure 13:
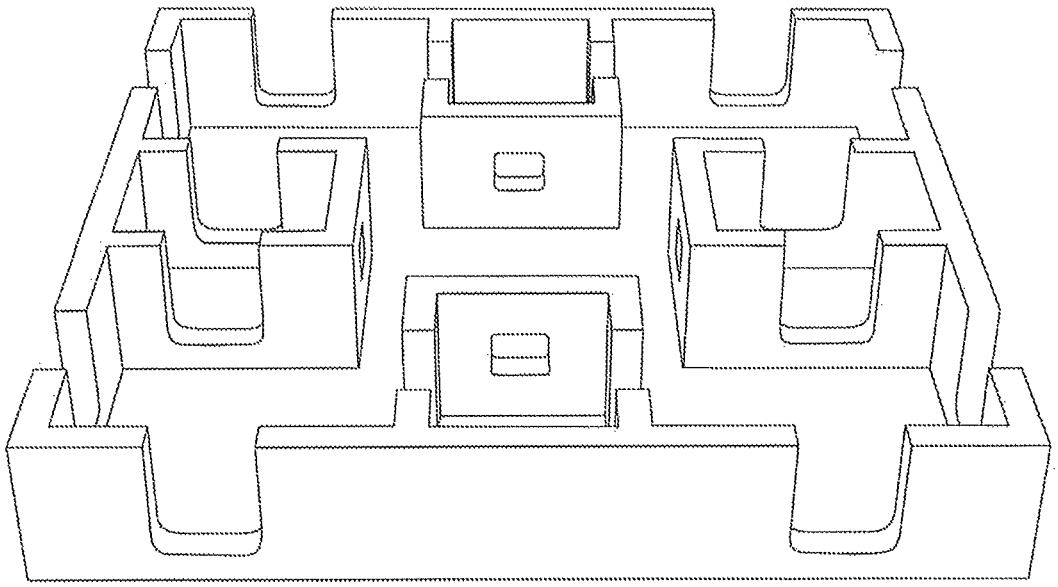
FIG. 13 shows another internal obstacle layout design of the modules, in accordance with an embodiment of the present disclosure.
Figure 14:
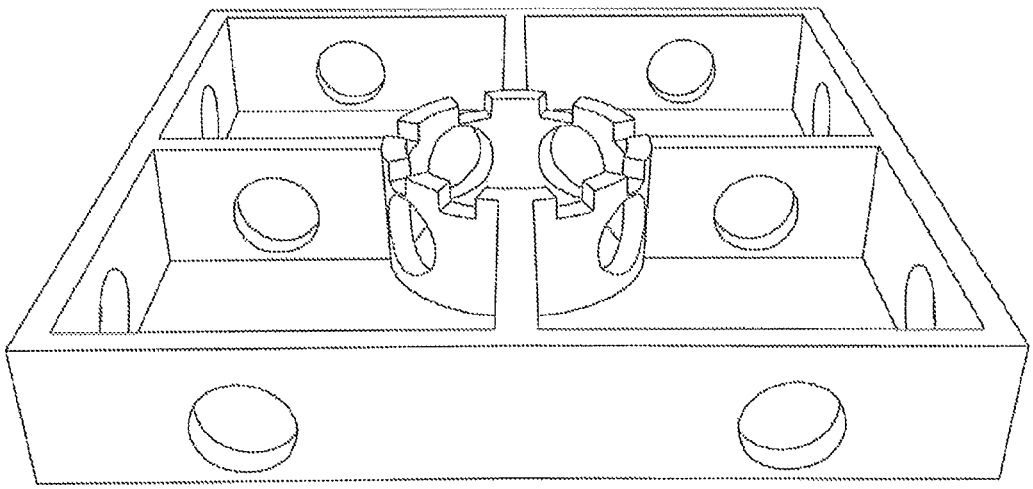
FIG. 14 shows another internal obstacle layout design of the modules, in accordance with an embodiment of the present disclosure.

FIG. 9 shows the top view of an exemplary embodiment of game field system with multiple modules and blowers. The exemplary illustration shows there are six modules connected together with three blowers providing air flow from consolidated air inlet. In the illustration, the square shape 10 is the modules showing only an outline shape, without internal layout design, and on top of the modules, there are connecting points 2 on corners. Modules are connected together via connecting pipeline 1 and form a complete air flow system so that the air flow can reach every module via the pipeline.

In summary, the disclosure provides an unique and innovative game field system, which can be expanded in any directions and in any size. The disclosure further provides a safe playing field with innovative "over the above" connection and the consolidated air inlet system for multiple blowers. For the "over the above" connection system, it innovatively uses the "hard connect" coupling set made from hard material to make the connecting and disconnecting accomplished easily and quickly.

The invention claimed is:

1. An inflatable game field system, the system comprising at least two modules, a connecting pipeline and an air inlet system, wherein each module comprises an inflatable formed by inflated walls forming an outside perimeter and an inside perimeter wall, wherein each module further comprises an inflated obstacle layout connected to said inside surface of said perimeter wall;

wherein said inside obstacle and said perimeter wall comprise a complete system; and wherein once said module is inflated, said perimeter wall and said internal obstacle are inflated at the same time, wherein said modules are connected via the connecting pipeline such that air flow can move freely between said modules, wherein the air inlet system connects to one of the modules at one end of the air inlet system and connects to blowers at another end of the air inlet system, wherein, once connected, the modules, the connecting pipeline and air inlet form one complete system where air flow can move freely, and wherein the modules, connecting pipeline and air inlet are comprised of soft and flexible fabric.

2. The system of claim 1, further comprising connecting points connected to the connecting pipeline on each of the modules, located on a top surface of said perimeter wall of the modules once the modules are fully inflated, and wherein, once connected and inflated, the position of the connecting pipeline is above the top of the inflated modules.

3. The system of claim 1, wherein the shape of the module is one of a square, rectangle, pentagon, hexagon, star or circle.

4. The system of claim 1, wherein the connecting pipeline connects to the connecting points disposed on top surface of the perimeter wall of the inflated modules via a coupling set made from hard material, wherein said coupling set is connected by way of complimentary engagement features.

5. The system of claim 1, wherein the connecting points on the top surface of the inflated modules are disposed at a position where it minimizes the connecting distance and maximizing connecting directions, wherein connecting points may be at least one of at the corner of the side wall joint and evenly or randomly located, and wherein each point may be the same size and use the same side of a coupling set for universal connection.

6. The system of claim 1, wherein each end of the connecting pipeline is fastened with the opposite side of the coupling set used by the connecting points on top surface of the modules such that the position of the connecting pipeline, once connected and inflated between modules, forms an arch above the top of both modules.

7. The system of claim 6, wherein the same coupling set is used for connecting between air inlet with the module.

8. The system of claim 6, comprising a consolidated air inlet for use with a plurality of blowers such that an end of consolidated air inlet connects to the connecting pipeline, which pipeline connects to the connecting point of the modules via coupling set, and such that the other end of the consolidated air inlet has multiple blower connecting points to allow multiple blowers to be attached to one air inlet.

9. The system of claim 8, wherein the consolidated air inlet can be in the shape of a triangle, square, or rectangle shape, and in any size capable of accommodating a plurality of blowers.

10. The system of claim 8, wherein the position of the consolidated air inlet can be vertical or horizontal, such that clear space between the module and air let allowing game players to pass is provided, and such that the connection between the air inlet with the module will form a configuration makes the clear space allowing game players to pass under.

11. The system of claim 1, wherein the game field system further comprises includes at least one air inlet system, wherein one end of an air inlet connects to a module via a connecting point, and wherein another end of an air inlet connects to at least one blower.

12. The system of claim 11, wherein the end of an air inlet connected to modules can connect directly to the connecting point on top of the modules, or connect to a connecting pipeline that connects to the connecting point on top of the modules; such that the connection forms an archway above the modules.

* * * * *